United States Patent [19]

Lauber

[11] Patent Number: 4,856,429

[45] Date of Patent: Aug. 15, 1989

[54] FLEXOGRAPHIC PRINTING MACHINE, ESPECIALLY FOR FLEXOGRAPHIC BLANK PRINTING

[75] Inventor: Peter Lauber, Stetten, Switzerland

[73] Assignee: Conprinta Ltd., Zurich, Switzerland

[21] Appl. No.: 237,851

[22] Filed: Aug. 29, 1988

[30] Foreign Application Priority Data

Sep. 10, 1987 [CH] Switzerland ..... 3502/87

[51] Int. Cl.[4] ..... B41L 3/02

[52] U.S. Cl. ..... 101/486; 101/92; 101/93.13; 101/93.01; 101/493

[58] Field of Search ..... 101/426, 216, 219, 91, 101/92, 93.01, 93.13, 122, DIG. 27, 486, 485, 488, 492, 493, 401.1; 400/146

[56] References Cited

U.S. PATENT DOCUMENTS 4,538,516 9/1985 Aaron ..... 101/219

FOREIGN PATENT DOCUMENTS 2079221 1/1982 United Kingdom ..... 101/DIG. 27

2160820 1/1986 United Kingdom ..... 101/DIG. 27

*Primary Examiner*—Eugene H. Eickholt

*Attorney, Agent, or Firm*—Bachman & LaPointe

[57] ABSTRACT

A flexographic printing machine, especially for flexographic web printing, has at least one printing unit. Such a printing unit comprises an endless printing band drawn on round a back-up cylinder and a tension roller, an impression cylinder, an engraved roller transferring the ink to the printing cylinder or to the printing belt, and an ink drier. A paper web runs through all the printing units.

In each printing unit, the bearings of the impression cylinder are fastened rigidly to the machine frame, whereas the bearings of the back-up cylinder and those of the tension roller are arranged displaceably on it, a tension rod keeping a distance (a) between the back-up cylinder and the tension roller constant.

10 Claims, 3 Drawing Sheets

FLEXOGRAPHIC PRINTING MACHINE, ESPECIALLY FOR FLEXOGRAPHIC BLANK PRINTING

BACKGROUND OF THE INVENTION

The invention relates to a flexographic printing machine, especially for flexographic web printing, which comprises at least one printing unit, each with an endless printing belt drawn on round a back-up cylinder and a tension roller, with an impression cylinder, with an engraved roller transferring the ink to the printing belt, and with an ink drier, and a paper web running through all the printing units and guided via an idler roller or idler rollers and a draw roller or draw rollers between the printing belt and the impression cylinder and through the ink drier. The back-up cylinder and the tension roller are arranged movably. The invention also relates to a process for lifting off a printing belt in a flexographic printing machine.

In conventional flexographic printing machines, a printing cylinder is used as a plate carrier or a rubber cylinder with a structured surface. The disadvantage of these printing cylinders carrying the negative printing pattern on their surface is that they have to be exchanged for each printing order. U.S. Pat. No. 3,518,940 therefore proposes a printing mechanism comprising an endless belt composed of polyethylene terephthalate, on which the flexible printing plates are mounted.

Messrs. Conprinta Ltd., Zurich, further developed the flexographic printing machines which have an endless printing belt and described them in their prospectus "Flexographic Printing Presses". The basic principle of these flexographic printing machines is illustrated in FIG. 1. A dimensionally stable endless belt 11 is drawn on a back-up cylinder 12 and a tension roller 14. Flexible printing plates 16 are fastened to the outer face of this endless belt, thus forming a printing belt 10. The printing ink is transferred to the printing plates 16 from an engraved roller 18 which dips into an ink bath (not shown). Excess ink is scraped off by a doctor blade 20 designed in the form of a negative angle. The paper web 22 guided in the direction of the arrow is pressed onto the printing plates by an impression cylinder 24 and printed on one side.

A short printing belt 10′ with an endless belt 11′comprising only a few printing plates 16′ and tensioned by a tension roller 14′ is represented by broken lines.

A cut-out from the printing belt 10 is shown in FIG. 2. The endless belt 11 serving as a carrier consists of a polyester film, for example 0.25 mm thick, especially polyethylene terephthalate. The physical properties of the transversely and longitudinally stretched film material are the same in all directions. The uniformity extends over a wide temperature and humidity range. Furthermore, the film-like belt material has a good elongation and impact resistance in the transverse and longitudinal directions. Finally, the flexible film material of the endless belt is chemically resistant and withstands oils, greases, printing inks, etc. The longitudinal sides of the endless belt 11 are provided with a perforation 26, through which engage knobs of the spiked disks transporting the belt in a known way. The printing belt can thereby be prevented from sliding on the rollers.

The flexible printing plates 16 conventionally consist of a photopolymer material or rubber and are glued to the endless belt 11 by means of a suitable adhesive. In the present example, the printing plates 16 have a structured surface 28 which produces the printing pattern.

The advantage of the above-described printing belt 10 is that the flexible printing plates 16 do not have to be mounted on the printing cylinder, but can be glued to the endless belt which is easily removable from the flexographic printing machine after use. All the printing belts used can be rolled onto a tube and stored in a space-saving way.

At present, flexographic prints of a width of up to 2.5 m are produced by means of printing belts of a length of up to 4.5 m. The flexographic printing machines are allowed to run at high speed and are equipped with checking instruments for the automatic monitoring and recording of the paper webs.

Flexographic printing machines according to the Conprinta system are conventionally equipped with 3 to 10 printing units. Any printing unit not participating in the current printing process can be equipped for the next working step during that available idle time. This usually takes 5 to 15 minutes. During this, the printing belt no longer required is removed, the new printing belt is fitted and the printed ink is exchanged.

Of course, instead of the printing belt, individual printing units can also contain a conventional structured or non-structured printing cylinder. This applies mainly to smooth or structured lacquering or to the application of a base color.

Flexographic printing machines of the type mentioned in the introduction work with back-up cylinders and tension rollers which have bearings fastened rigidly to the machine frame. After the paper web is positioned correctly (the color patterns printed on one another must match exactly), the impression cylinder is pressed onto the endless printing belt drawn over the back-up cylinder, the paper web lying between the printing belt and the impression cylinder. Likewise, the engraved roller which applies the ink is laid against the printing belt in the region of the back-up cylinder.

During normal printing, it occasionally happens that a printing belt has to be taken out of operation for a short time, for example if ink dries on one or more printing plates. For this purpose, the corresponding impression cylinder is raised, as a result of which the paper web also lifts off from the printing belt. The printing belt running at the same speed as the paper web can now be stopped and the appropriate printing plate or printing plates cleaned. After the printing belt has accelerated to normal speed once more, the impression cylinder together with the paper web is pressed against the printing belt again.

The paper misprinted during this operation is detected by an automatic monitoring system and separated out later.

The disadvantage of uncoupling and lifting off the impression cylinder is that the tension of the paper web is changed or even cancelled. This can result in changes in position of the paper web in all the printing units. The entire installation often has to be re-adjusted in such cases.

Attempts have been made, by fitting a compensating linkage, to ensure a compensation of tension in the paper web when the impression cylinder is lifted off. However, such compensating linkages involve a high outlay in every respect.

British Application No. 2,102,733 makes known a printing machine with four printing units which are arranged round a common impression cylinder. A web of material to be printed is guided round the impression cylinder. Each of the printing units serves for applying a special ink and comprises a flexible printing belt which is driven as a result of frictional force and which can be laid individually against a common impression cylinder and removed from it. The back-up cylinder pressing the printing belt onto the impression cylinder or onto the web of material guided on it is arranged on the first carrier, and the engraved roller coating the ink onto the printing belt is arranged on the second carrier. When there is an interruption in printing, for example, in order to lift off the back-up cylinder by means of the first carrier the engraved roller has to be lifted off beforehand by means of the second carrier. There must always be two separate cylces of movement, with the inclusion of the engraved roller, this involving a high outlay and being complicated.

The inventor made it his object to provide a flexographic printing machine of the type mentioned in the introduction, in which a printing belt can be taken out of operation, without engraved roller being displaced or the tension of the paper web being impaired, but the prime costs and operating costs of the flexographic printing machine are to be no higher or not appreciably higher than hitherto. A process for lifting off a printing belt in a flexographic printing machine of the above-mentioned design is also to be developed.

SUMMARY OF THE INVENTION

Where the machine is concerned, the object is achieved, according to the invention, because, in each printing unit, the bearings of the impression cylinder are fastened rigidly to the machine frame, whereas the bearings of the back-up cylinder are arranged so as to be displaceable in at least two directions and those of the tension roller so as to be displaceable in at least one direction.

The tension of the paper web is not influenced when the printing belt is lifted off as a result of the displacement of the back-up cylinder. On the other hand, as mentioned above, the paper web is not printed in the respective printing unit during this time.

The back-up cylinders are displaceable preferably both in the vertical direction and in the horizontal and axial directions. By horizontal is meant, here, in the direction of the paper web running through between the printing belt and the impression cylinder, by vertical is meant perpendicular to this direction.

The vertical and horizontal displacement of the back-up cylinder and consequently of the printing belt serves for the lifting off, for example for the cleaning of the printing plates. The result of a displacement of the printing belt in the axial direction of the back-up cylinder, the printing patterns can be corrected if the varicolored prints do not match one another with sufficient accuracy.

As regards the tension roller, it is sufficient, in practice, if this is displaceable in the vertical direction. Thus, especially vertical movements of the back-up cylinder can be compensated, and the printing belt remains tensioned or is retensioned. A slight horizontal displacement of the back-up cylinder has scarcely any effect on the best possible position of the tension roller.

The mechanical components provided for linear guide units or linear guides for displacing a printing cylinder are known per se to the machine builder, and these will therefore not be discussed in any more detail here. There are also means known per se which, during a vertical and/or horizontal displacement of the back-up cylinder, keep the distance between its axis and the axis of the corresponding tension roller constant.

The bearings of the engraved roller of a printing unit, like those of the impression cylinder, can be mounted rigidly in the machine frame. However, flexographic printing machines appropriately have printing units with an engraved roller which can be uncoupled from its drive shaft and which can be exchanged automatically during the set-up time of the particular printing unit. The details of this system are described in copending U.S. patent application Ser. No. 189,537, filed May 3, 1988. As suggested, the exchange or displacement of the engraved roller for the lifting off of the printing belt is not necessary.

The process according to the invention for lifting off a printing belt in a flexographic printing machine of the above-mentioned design is defined in that the back-up cylinder guiding the printing belt is first lifted off from the engraved roller and then from the impression cylinder guiding the paper web, and the period of time required for a point on the printing belt to move forwards from the engraved roller to the impression cylinder corresponds to that period of time which elapses between the lifting off of the printing belt from the engraved roller and its lifting off from the impression cylinder.

According to this process, the back-up roller is moved away in such a manner that the ink picked up from the engraved roller is still delivered to the paper web running through. On the other hand, however, printing plates without ink are prevented from resting on the paper web.

For the same reason, namely preventing dry printing plates from resting on the paper web, the flexographic printing machine is started up in such a way that first the ink is picked up and the printing plates covered with ink run up to the paper web, and only then is the printing belt pressed onto the paper web.

BRIEF DESCRIPTION OF THE DRAWINGS

The invention is explained in detail with reference to the exemplary embodiment illustrated in the drawing. In the functional schematic drawing.

DETAILED DESCRIPTION

Figure 1:
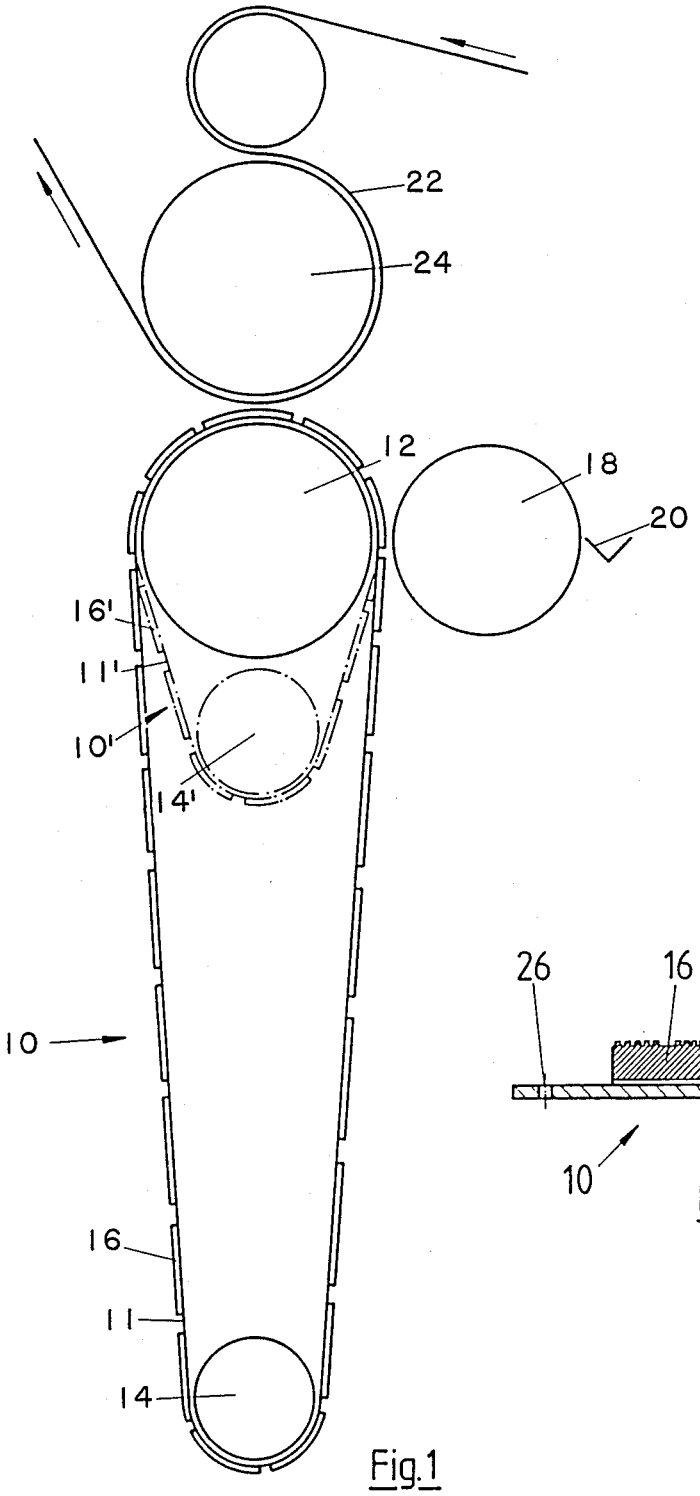
FIGS. 1 and 2 represent a prior art flexographic printing machine.
Figure 2:
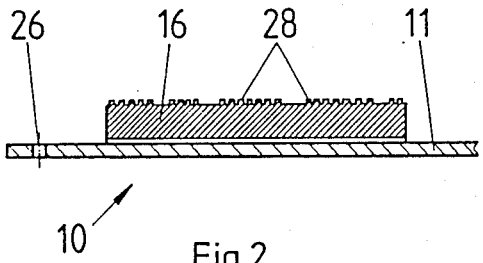
Figure 3:
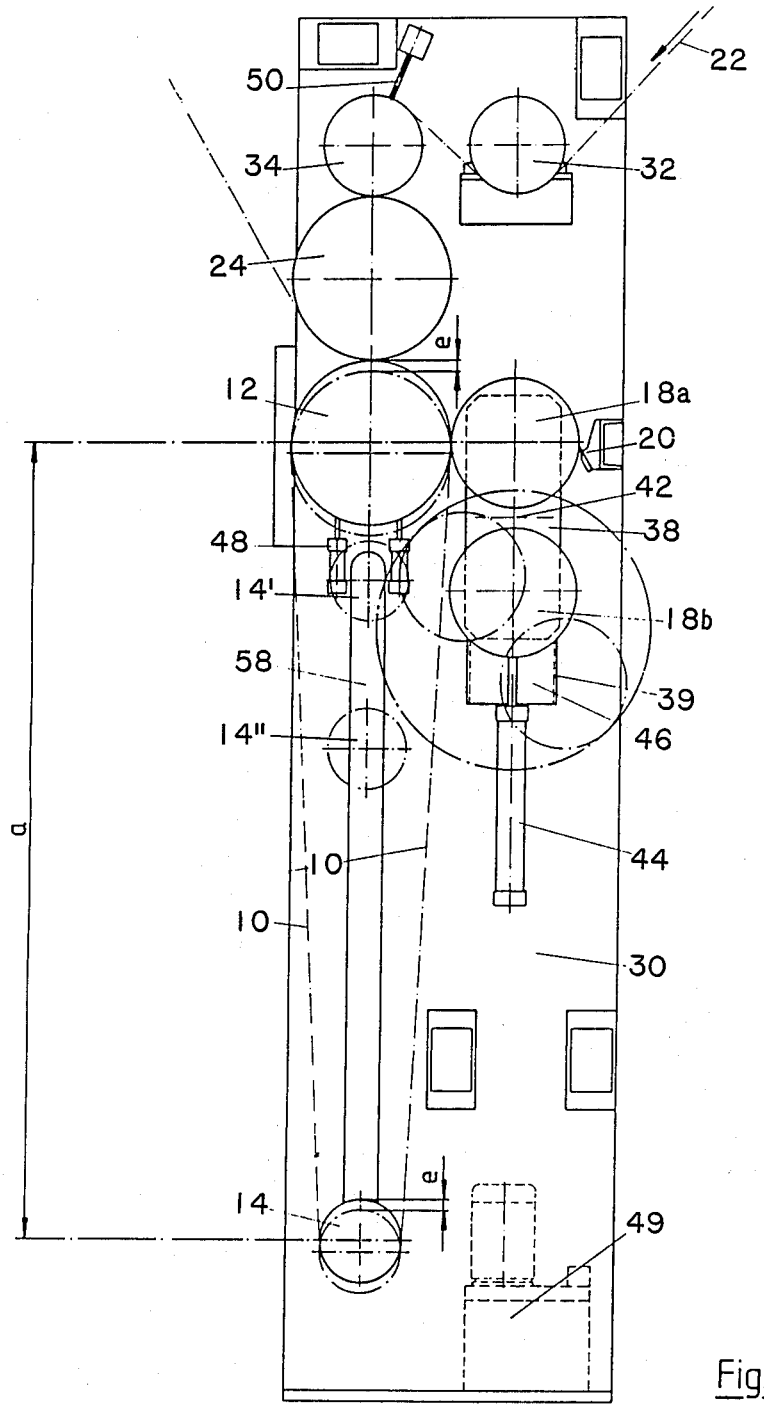
FIG. 3 shows a side view of a printing unit of a flexographic printing machine of the present invention.
Figure 4:
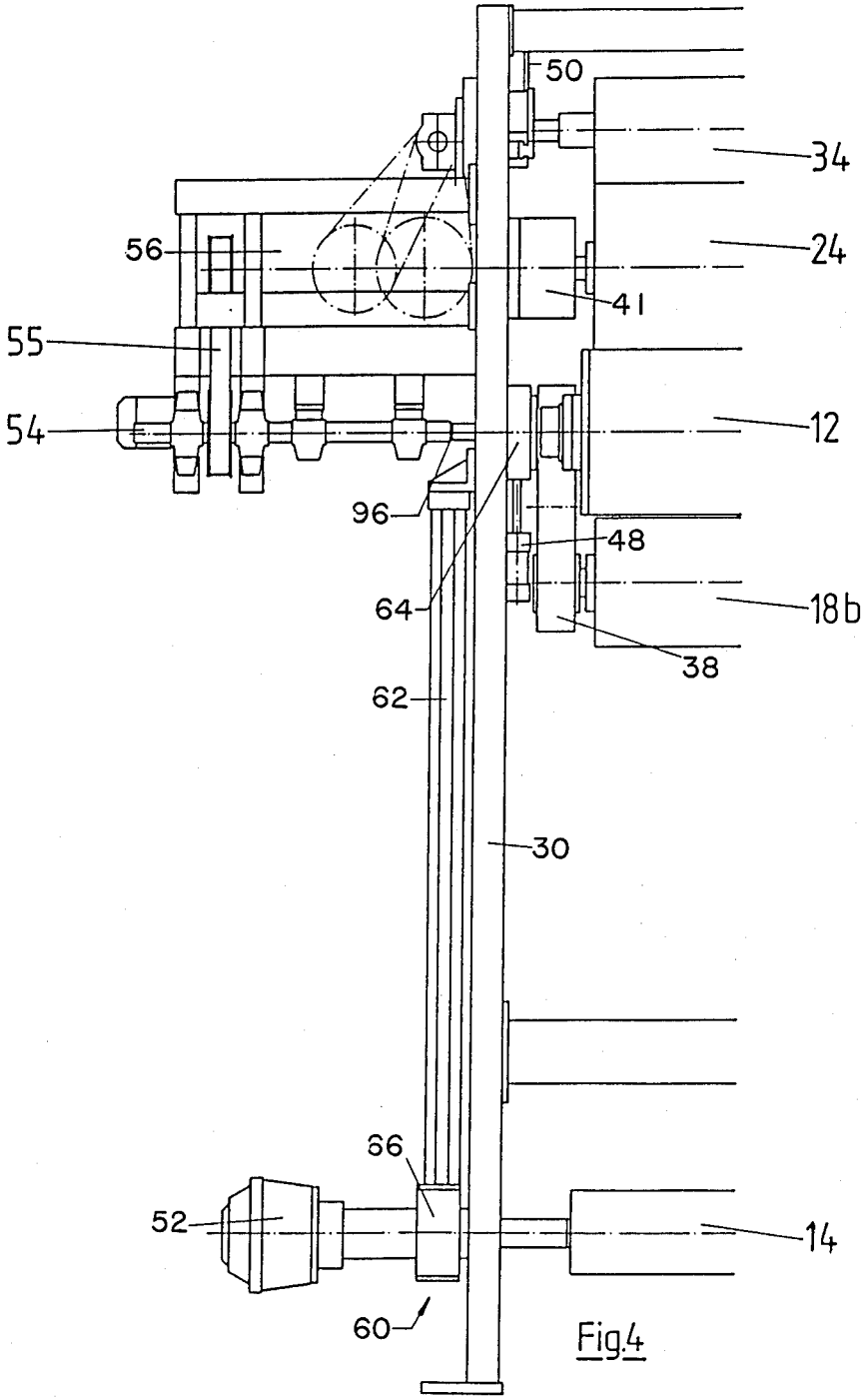
FIG. 4 shows a reduced part view of FIG. 3 from the left.

The printing unit, shown in FIGS. 3 and 4, of a flexographic printing machine contains a machine frame 30 with the rollers and cylinders guiding and printing the paper web 22, their suspensions and their drive members, attention being drawn to FIGS. 1 and 2. The constructional parts corresponding to the state of the art are not all shown and described in detail.

The paper web 22 is guided, via an idler roller 32 mounted rigidly in the machine frame, to the rubberized draw roller 34, which latter can be lifted off from the impression cylinder 24 by means of a printing cylinder 50, with the result that the paper web is no longer clamped between the draw roller 34 and the impression cylinder 24. The paper web 22 further loops round the impression cylinder 24, which has bearings 41 fastened rigidly to the machine frame 30, and, during passage between the back-up cylinder 12 and the impression cylinder 24, is printed with the ink transferred to the printing belt 10 from the working engraved roller 18*a*.

As described in detail in co-pending U.S. patent application Ser. No. 189,537, the working engraved roller 18*a* is mounted in two pivoting arms 38 which are rotatable through at least 180° and which are fixed in a position stop (not shown). A stand-by engraved roller 18*b* is mounted at the other end of the extended pivoting arms 38 mounted in mutually opposite side spars of the machine frame 30. As a result of the lowering of the pivoting arms 38 into the position marked by dot-and-dash lines in FIG. 3, the necessary free space, also in respect of the doctor blade or scraper 20, is provided, and the pivoting arms 38 can now be rotated through 180° about an axis of rotation 42.

The lowering of the pivoting arms 38 together with the engraved rollers 18*a*, 18*b* up to a stop is carried out by means of lifting cylinders 44 fastened to a machine frame 30 on both sides, with a lowerable protective housing 46 arranged directly above them, which themselves each guide a piston rod (not shown) supporting the pivoting arm 38. The upper part of the pivoting arm 38 travels on a rail guide 39 from the said positioning stops and can now be rotated through 180° by means of a unit exerting a torque. After the lifting and simultaneous introduction into the positioning stops, the previously stand-by engraved roller becomes the new working engraved roller 18*a*. The engraved roller on stand-by after rotation, namely the previous working roller, can quickly be cleaned or replaced by another engraved roller.

If a long printing belt 10 is used for the work, the tension roller 14 is outside the range of rotation of the engraved rollers 18*a*, 18*b*. When the engraved rollers are exchanged, only the printing belt 10 has to be removed. In contrast, if a short printing belt 10' (FIG. 1) is used for the work, before the engraved rollers are rotated not only the printing belt 10' has to be removed, but also the tension roller 14' has to be lowered into the position 14'' so that sufficient free space is obtained.

The axis 44 of the back-up cylinder 12 and the axis of the tension roller 14 are at the distance a from one another. During a displacement of the back-up cylinder 12 in the vertical and/or horizontal direction, this distance must remain constant, so that the printing belt 10 has the correct tension during printing. This is obtained by means of a tension rod 58 and is true irrespective of the size of the distance a.

The back-up cylinder 12 and/or the tension roller 14 can be lowered by means of the lifting cylinders 48 by the distance e which, for example, is approximately 50 mm, for the purpose of cleaning, removing exchanging the printing belt 10. Before the lowering of the back-up cylinder 12 or in the position of readiness for starting the printing operation, the printing belt is approximately 2 mm away from the engraved roller 18*a* and the impression cylinder 24.

The hydraulic unit 49 is indicated in FIG. 3. The drive units 52 for the tension roller 14, 54 for the back-up cylinder 12 and 56 for the impression cylinder 24 are of a conventional design familiar to a person skilled in the art, as are the, if appropriate, telescopically extendable spindles or shafts for transmitting the torques to the corresponding rollers. According to FIG. 4, the unit 54 exerts no drive force of its own, but obtains this via transmission means. The unit 54 drives the back-up cylinder 12 via a cardan shaft 96 which can absorb movements in all directions. The cardan shaft 96 also allows the axial displacement of the back-up cylinder 12.

The unit 56 for the impression cylinder 54 is driven via a toothed belt 55, this unit also driving the draw roller 34, as indicated by dot-and-dash lines in FIG. 4.

The printing belt 10 and the paper web 22 are driven separately, but they must always run at exactly the same speed. When there is a change in the relative speed, the pull on the printing belt 10 is varied by rotating the tension roller 14 somewhat more quickly or more slowly. In this way, an additional or a lower torque is exerted on the printing belt.

The tension roller 14 is suspended via a spindle lifting system 69. As shown in FIG. 4, the height of the tension roller 14 is varied as a result of the rotation of the threaded spindle 61 which passes through the tension-roller bearing 66.

The flexographic printing process is especially suitable for large-surface multicolor prints. The flexographic printing process is also extremely cost-effective. In flexographic web printing, a paper web used as a covering sheet for packaging cardboard is printed.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for lifting off a printing belt in a flexographic printing machine comprising at least one printing unit; each printing unit having an endless printing belt drawn on round a back-up cylinder mounted on bearings and a tension roller mounted on bearings, an impression cylinder mounted on bearings, an engraved roller transferring the ink to the printing belt, and an ink drier; and a paper web running through all the printing units and guided via an idler roller or idler rollers and a draw roller or draw rollers between the printing belt and the impression cylinder and through the ink drier; means for displacing the back-up cylinder and the tension roller, wherein, in each printing unit, the bearings of the impression cylinder are fastened rigidly to the machine frame, whereas the bearings of the back-up cylinder are arranged so as to be displaceable by said means for displacing in at least two directions and the bearings of the tension roller are arranged so as to be displaceable by said means for displacing in at least one direction, comprising the steps of lifting the back-up cylinder guiding the printing belt off from the engraved roller and then from the impression cylinder guiding the paper web such that the period of time required for a point on the printing belt to move forwards from the engraved roller to the impression cylinder corresponds to that period of time which elapses between the lifting off of the printing belt from the engraved roller and its lifting off from the impression cylinder.

2. A process as claimed in claim 1 including displacing the back-up cylinder in the horizontal direction such that the printing belt, before being lifted off from the paper web running round the impression cylinder is moved approximately 2 mm away from the working engraved roller.

3. A flexographic printing machine having a machine frame, especially for flexographic web printing, which comprises at least one printing unit; each printing unit having an endless printing belt drawn on round a back-up cylinder mounted on bearings and a tension roller mounted on bearings, an impression cylinder mounted on bearings, an engraved roller transferring the ink to the printing belt, and an ink drier; and a paper web running through all the printing units and guided via an idler roller or idler rollers and a draw roller or draw rollers between the printing belt and the impression cylinder and through the ink drier; means for displacing the back-up cylinder and the tension roller, wherein, in each printing unit, the bearings of the impression cylinder are fastened rigidly to the machine frame, whereas the bearings of the back-up cylinder are arranged so as to be displaceable by said means for displacing in at least two directions and the bearings of the tension roller are arranged so as to be displaceable by said means for displacing in at least one direction.

4. A flexographic printing machine as claimed in claim 1 wherein the bearings of the back-up cylinder are arranged so as to be displaceable in the vertical, horizontal and axial directions.

5. A flexographic printing machine as claimed in claim 1 wherein the bearings of the tension roller are arranged so as to be displaceable in the vertical direction.

6. A flexographic printing machine as claimed in claim 4 including means which, during a vertical and/or horizontal displacement of the back-up cylinder, keep the distance (a) between its axis and the axis of the corresponding tension roller constant.

7. A flexographic printing machine as claimed in claim 3 wherein said means for displacing includes linear guides for the displacement of the back-up cylinder and tension roller.

8. A flexographic printing machine as claimed in claim 3 wherein said means for displacing includes hydraulic cylinders for adjusting the height of the bearings of the back-up cylinder and lifting spindles arranged on the end faces of the bearings of the tension roller and driven by spindle motors for adjusting the tension roller.

9. A flexographic printing machine as claimed in claim 6 wherein the means of keeping the distance (a) between the axes constant includes lifting spindles which receive a bearing of the back-up cylinder and a bearing of the tension roller.

10. A flexographic printing machine as claimed in claim 3 wherein the height of the bearings of the back-up cylinder and/or of the tension roller are individually adjustable on both sides of the bearings.

* * * * *